US009272510B2

(12) United States Patent
Ohnishi

(10) Patent No.: US 9,272,510 B2
(45) Date of Patent: Mar. 1, 2016

(54) PRINTING APPARATUS, INK JET HEAD, AND PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/504,441

(22) Filed: Oct. 2, 2014

(65) Prior Publication Data

US 2015/0098028 A1 Apr. 9, 2015

(30) Foreign Application Priority Data

Oct. 7, 2013 (JP) ..... 2013-210239
Apr. 26, 2014 (JP) ..... 2014-084628

(51) Int. Cl.
*B41J 2/045* (2006.01)
*B41J 2/14* (2006.01)

(52) U.S. Cl.
CPC ..... *B41J 2/04581* (2013.01); *B41J 2/04593* (2013.01); *B41J 2/14233* (2013.01); *B41J 2/14274* (2013.01)

(58) Field of Classification Search
CPC ..... B41J 2/04581; B41J 2/04593; B41J 2/14233; B41J 2/14274
USPC ..... 347/71
See application file for complete search history.

(56) References Cited

U.S. PATENT DOCUMENTS

| | | | | |
|---|---|---|---|---|
| 5,812,163 | A * | 9/1998 | Wong | 347/68 |
| 2001/0022596 | A1* | 9/2001 | Korol | 347/10 |
| 2002/0191055 | A1* | 12/2002 | Shingai et al. | 347/70 |
| 2003/0214556 | A1* | 11/2003 | Cabal et al. | 347/44 |
| 2006/0066692 | A1* | 3/2006 | Kojima | 347/72 |

* cited by examiner

*Primary Examiner* — Stephen Meier
*Assistant Examiner* — Alexander D Shenderov
(74) *Attorney, Agent, or Firm* — Jianq Chyun IP Office

(57) ABSTRACT

There is provided a printing apparatus which performs printing by an ink jet method, including: an ink jet head which ejects ink droplets; and a driving signal output portion which outputs a driving signal that causes the ink droplets to be ejected from the ink jet head. The ink jet head includes: a nozzle which ejects the ink droplets; an ink chamber which stores ink to be ejected from the nozzle; and a piezoelectric element which causes the ink droplets to be ejected from the nozzle. The piezoelectric element causes all of the ink in the ink chamber to be ejected from the nozzle by being displaced corresponding to the driving signal.

6 Claims, 10 Drawing Sheets

PRINTING APPARATUS, INK JET HEAD, AND PRINTING METHOD

CROSS REFERENCE TO RELATED APPLICATIONS

This application claims the priority benefit of Japan application serial no. 2013-210239, filed on Oct. 7, 2013, and Japanese Patent Application No. 2014-084628, filed on Apr. 26, 2014. The entirety of the above-mentioned patent applications are hereby incorporated by reference herein and made a part of this specification.

TECHNICAL FIELD

The present invention relates to a printing apparatus, an ink jet head, and a printing method.

DESCRIPTION OF THE BACKGROUND ART

In the related art, an ink jet printer which performs printing by an ink jet method is widely used (for example, refer to Internet URL http://www.mimaki.co.jp). In the ink jet printer, printing is performed by ejecting ink droplets from nozzles of an ink jet head. In addition, a driving element which causes the ink droplets to be ejected from the nozzles is provided at a position of the nozzles of the ink jet head. As the driving element, for example, a piezoelectric element or the like is widely used.

SUMMARY

In the ink jet head, when a piezoelectric element is used as a driving element, the piezoelectric element causes ink droplets to be ejected from nozzles by being displaced corresponding to a predetermined driving signal. In addition, in this case, by being displaced corresponding to the driving signal, the piezoelectric element vibrates a meniscus of ink which is formed at a position of the nozzles, and ejects the ink droplets from the nozzles. In addition, more particularly, as displacement corresponding to the driving signal, for example, after being displaced in a direction to push the ink out of the nozzles, the piezoelectric element is displaced in a direction to pull the ink back to the inside of the nozzles. In addition, accordingly, a part of the ink pushed out of the nozzles is separated from the meniscus, and the separated ink droplets are subjected to flight toward a medium to be printed on.

However, when the ink droplets are ejected in this manner, for example, a size of the ink droplets is determined by a balance of a plurality of forces, which is a balance between a force to push the ink out of the nozzles and a force to pull the ink back to the inside of the nozzles after pushing out. For this reason, there is a concern that it is difficult to make the size of the ink droplets uniform with high accuracy and an irregularity in amount (size) of the ink droplets easily occurs.

In addition, when the printing is performed by the ink jet method, the ink ejected from the nozzles is influenced by air resistance until the ink reaches the medium. It can be considered that the less the ejecting velocity of the ink droplets, the larger the influence of the air resistance. For this reason, in order to reduce the influence of air resistance, it is desirable that the ejecting velocity of the ink droplets increase.

However, when the ink droplets are ejected by the above-described method, for example, if the force to push the ink out of the nozzles increases, the velocity of the ink droplets increases and the ink droplets enlarge at the same time. For this reason, there is a case where it is difficult to increase the force to push the ink out of the nozzles in a state where the size of the ink droplets is maintained to be small. In addition, as a result, there is a case where it is difficult to increase the ejecting velocity of the ink droplets.

For this reason, in the related art, when the printing is performed by the ink jet method, it is desirable that the size of the ink droplets and the velocity of the ink droplets can be controlled independently. The invention is to provide a printing apparatus, an ink jet head, and a printing method which can solve the above-described problems.

In order to solve the above-described problem, the invention has the following configurations.

Configuration 1

There is provided a printing apparatus which performs printing by an ink jet method including: an ink jet head which ejects ink droplets; and a driving signal output portion which outputs a driving signal that causes the ink droplets to be ejected from the ink jet head. The ink jet head includes: a nozzle which ejects the ink droplets; an ink chamber which stores the ink to be ejected from the nozzle; and a piezoelectric element which causes the ink droplets to be ejected from the nozzle. The piezoelectric element causes all of the ink in the ink chamber to be ejected from the nozzle by being displaced corresponding to the driving signal.

In this configuration, for example, by controlling the displacement of the piezoelectric element corresponding to the driving signal, it is possible to appropriately eject the ink droplets from the nozzle. In addition, in this case, since all of the ink in the ink chamber is ejected from the nozzle, for example, regardless of a balance of a plurality of forces, which is a balance between a force to push the ink out of the nozzle and a force to pull back the ink after pushing out, it is possible to appropriately eject a certain volume of the ink droplets. For this reason, in this configuration, for example, it is possible to appropriately suppress the irregularity in volume of the ink droplets regardless of the force to push out the ink. In addition, accordingly, it is possible to eject a certain volume of ink droplets at the most appropriate velocity by a more appropriate method, and to appropriately perform the printing with high accuracy. In addition, for example, it is difficult to be influenced even by viscosity of the ink.

In addition, in this configuration, it is possible to eject the ink droplets from the nozzle regardless of timing to pull the ink back to the inside of the nozzle and an operation of a wave form or the like. For this reason, for example, without considering an operation to pull the ink back to the inside of the nozzle, it is possible to appropriately increase the force to push the ink out of the nozzle. In addition, accordingly, for example, it is possible to appropriately increase the ejecting velocity of the ink droplets. For this reason, in this configuration, for example, it is possible to increase the ejecting velocity of the ink droplets having a small size, and to reduce the influence of air resistance which is applied to the ink droplets.

Furthermore, ejecting all of the ink in the ink chamber from the nozzle may mean, for example, ejecting substantially all of the ink in the ink chamber from the nozzle. In addition, ejecting substantially all of the ink in the ink chamber from the nozzle means, for example, ejecting all of the ink in the ink chamber from the nozzle in the designed operation. This may mean that, for example, in the designed operation, without intentionally leaving a part of the ink by the operation to pull the ink back to the inside of the nozzle or the like, all of the ink introduced into the ink chamber before ejecting is ejected.

Configuration 2

The ink jet head further includes: a nozzle plate in which the hole-shaped nozzle and a cavity portion connected to the nozzle are formed; and a thin film which forms the ink chamber between the bottom surface of the cavity portion and the thin film by covering the cavity portion of the nozzle plate from a side opposite to the nozzle. The piezoelectric element causes all of the ink in the ink chamber to be ejected from the nozzle by pressing the thin film to be brought into contact with the bottom surface of the cavity portion of the nozzle plate. The piezoelectric element may press the thin film, for example, so that the thin film is directly or indirectly in contact with the bottom surface of the cavity portion of the nozzle plate. The thin film being in contact with the bottom surface of the cavity portion of the nozzle plate means that, for example, the thin film is in contact with the bottom surface of the cavity portion to cover the entire bottom surface of the cavity portion. In this configuration, for example, it is possible to appropriately eject all of the ink in the ink chamber from the nozzle by the driving signal.

Configuration 3

The ink jet head further includes an elastic member which is disposed between the piezoelectric element and the thin film. At a timing of ejecting the ink droplets from the nozzle, the piezoelectric element presses the thin film via the elastic member. As the elastic member, it is possible to appropriately use a member having flexibility which is formed of rubber or the like. In this configuration, for example, it is possible to appropriately eject all of the ink in the ink chamber from the nozzle by the driving signal.

Configuration 4

Corresponding to the driving signal, by being displaced to the side opposite to the nozzle, the piezoelectric element pulls a preset amount of the ink into the ink chamber, and by being displaced to the side of the nozzle after that, the piezoelectric element causes all of the ink in the ink chamber to be ejected from the nozzle. Pulling the ink into the ink chamber means, for example, pulling the ink into the ink chamber from an ink storage portion, such as an ink cartridge or an ink tank, through an ink supply path.

In this configuration, for example, by controlling a displacement amount of the piezoelectric element to the side opposite to the nozzle, it is possible to appropriately control the amount of the ink to be introduced into the ink chamber before ejecting. In addition, after that, by ejecting all of the ink in the ink chamber from the nozzle, it is possible to appropriately eject a desired volume of ink droplets from the nozzle. For this reason, in this configuration, for example, it is possible to more appropriately perform the printing with high accuracy.

Configuration 5

The driving signal output portion outputs the plurality of types of driving signals which has different displacement amounts to the side opposite to the nozzle. The piezoelectric element causes the different volume of ink droplets to be ejected from the nozzle according to which of the plurality of types of driving signals is supplied.

In this configuration, for example, corresponding to the plurality of types of driving signals, the volume of the ink droplets ejected from the nozzle can be variable at a plurality of stages. In addition, accordingly, for example, it is possible to form dots of the ink at a plurality of sizes, on the medium. Furthermore, in this case, according to the configuration in which all of the ink in the ink chamber is ejected from the nozzle, it is possible to appropriately suppress the irregularity in the volume of the ink droplets. For this reason, in this configuration, for example, it is possible to appropriately perform a gradation printing (multi-gradation printing) with high accuracy by using the dots of the ink at the plurality of sizes.

Furthermore, as a method of making the volume of the ink droplets ejected from the nozzle variable at the plurality of stages, which is different from the above-described method, for example, a method of using the configuration in which the ink is pulled back to the inside of the nozzle after pushing the certain amount of the ink out of the nozzle, and controlling the force or the timing to pull back the ink or the like, can also be considered. However, in the method, due to difference in the volume of the ink droplets, there is a concern that the ejecting velocity (initial velocity) of the ink droplets is different. In addition, as a result, due to the difference in the volume of the ink droplets, it can be considered that an error in a landing position of the ink droplets occurs.

In contrast, in the configuration 5, since all of the ink in the ink chamber is ejected from the nozzle, for example, an influence of the operation to pull the ink back to the inside of the nozzle does not occur. For this reason, in this configuration, for example, it is also possible to appropriately suppress the difference in the ejecting velocity of the ink droplets caused by the difference in the volume of the ink droplets. In addition, accordingly, it is possible to more appropriately perform the printing with greater accuracy.

In addition, the ink jet head may include the plurality of nozzles. In this case, the ink jet head includes the ink chambers and piezoelectric elements corresponding to each of the plurality of nozzles. In addition, the driving signal output portion selects the driving signal supplied to each of the nozzles according to the size of the dots of the ink to be formed from each of the nozzles. In addition, the selected driving signal is supplied to each of the nozzles.

Configuration 6

The ink chamber has an opening portion at a position different from the position of a hole which is connected to the nozzle and formed on any surface, and stores the ink to be supplied to the nozzle at a previous stage of the nozzle. The ink jet head further includes the thin film which covers the opening portion of the ink chamber. A main surface of the piezoelectric element is disposed on the thin film to be along the thin film, and the piezoelectric element applies pressure to the ink chamber by being displaced corresponding to the driving signal.

In this configuration, corresponding to the driving signal, for example, the piezoelectric element is displaced to be bent on the thin film of the opening portion. According to the displacement, the pressure is applied to the ink chamber via the thin film of the opening portion. In addition, in this case, for example, as the main surface is disposed to be overlapped with the opening portion of the ink chamber, compared to in a case where the main surface is vertically disposed with respect to the ink chamber, the piezoelectric element can be in contact with a wider area with respect to the thin film of the opening portion. In addition, for example, it can be considered that the piezoelectric element is displaced in a form along the shape of the ink chamber. For this reason, in this configuration, for example, by the piezoelectric element, it is possible to further stabilize and apply the pressure with respect to the ink chamber. In addition, accordingly, for example, it is possible to further stabilize and perform the ejecting of the ink droplets from the nozzle.

Furthermore, in the piezoelectric element, the main surface of the piezoelectric element is the widest surface. In addition, regarding the disposing of the piezoelectric element, disposing the piezoelectric element vertically means disposing the piezoelectric element to expand and contract the piezoelectric element in a direction orthogonal to the thin film, for example, disposing the piezoelectric element in the ink jet head in the related art.

In addition, in the ink chamber, for example, the hole which is connected to the nozzle is formed on the bottom surface of a cavity which constitutes the ink chamber. In addition, the opening portion of the ink chamber is formed on a surface facing the bottom surface, for example. In addition, for example, the thin film may be a thin film which covers the cavity portion of the nozzle plate from the side opposite to the nozzle. In this case, for example, the thin film forms the ink chamber between the bottom surface of the cavity portion of the nozzle plate and the thin film.

Configuration 7

Corresponding to a change in the driving signal, a center portion of the piezoelectric element is bent to face the direction of the nozzle, and the piezoelectric element applies the pressure to the ink chamber via the thin film. Corresponding to the pressure applied to the ink chamber by the piezoelectric element, the nozzle ejects the ink droplets. In this configuration, for example, it is possible to appropriately perform the ejecting of the ink droplets from the nozzle.

Configuration 8

The piezoelectric element has electrodes which receive the driving signal at one end and at the other end in a direction along the surface of the thin film. The direction along the surface of the thin film is, for example, a direction perpendicular to an ejecting direction of the ink droplets from the nozzle. In this configuration, for example, it is possible to appropriately displace the piezoelectric element.

In addition, the piezoelectric element may have the electrodes which receive the driving signal on the surface and the rear surface of the piezoelectric element. In this case, the rear surface of the piezoelectric element is an interface between the piezoelectric element and the thin film. In this configuration, for example, it is possible to appropriately displace the piezoelectric element.

Configuration 9

By being displaced in a shape along the surface on which the hole connected to the nozzle is formed in the ink chamber, the piezoelectric element causes the ink droplets to be ejected from the nozzle. In this configuration, for example, when the ink droplets are ejected from the nozzle, it is possible to appropriately eject all of the ink in the ink chamber.

Furthermore, displacing the piezoelectric element in a shape along the surface on which the hole connected to the nozzle is formed in the ink chamber means that, for example, the piezoelectric element is displaced to eject substantially all of the ink in the ink chamber. In addition, more particularly, for example, the piezoelectric element may be displaced so that the thin film and a nozzle forming surface are in contact or almost in contact with each other.

Configuration 10

The opening portion of the ink chamber is formed on a surface facing the nozzle forming surface which is a surface on which the hole connected to the nozzle is formed in the ink chamber. When the piezoelectric element causes the ink droplets to be ejected from the nozzle, the piezoelectric element is displaced so that at least a part of the thin film and at least a part of the nozzle forming surface of the ink chamber are in contact with each other. In this configuration, for example, when the ink droplets are ejected from the nozzle, it is possible to more appropriately eject the ink in the ink chamber.

Furthermore, it is preferable that the nozzle forming surface of the ink chamber be formed in a shape that is compatible with a method (deflection method of the piezoelectric element) of the displacement of the piezoelectric element. For example, the shape of the nozzle forming surface of the ink chamber can be considered as a shape in which a depth gradually increases toward the center portion, in a direction which links one end and the other end provided with the electrodes in the piezoelectric element. In this configuration, for example, it is possible to more appropriately bring the thin film and the nozzle forming surface into contact with each other.

In addition, for example, on the nozzle forming surface of the ink chamber, it can be considered that a part which is in contact with the thin film is formed to be flat. In addition, in particular, it can be considered that a peripheral part of the hole connected to the nozzle is made to be a flat shape among the parts which are in contact with the thin film, for example. In addition, on the thin film, a part which is in contact with the nozzle forming surface may be formed in a convex shape. In this configuration, for example, it is possible to more appropriately bring the thin film and the nozzle forming surface into contact with each other.

Configuration 11

Corresponding to the change in the driving signal, after performing a first displacement which bends the center portion of the piezoelectric element to face a direction opposite to the nozzle, the piezoelectric element performs a second displacement which bends the center portion to face the direction of the nozzle. By performing the first displacement, the piezoelectric element pulls the preset amount of the ink into the ink chamber, and by performing the second displacement, the piezoelectric element causes all of the ink in the ink chamber to be ejected from the nozzle.

In this configuration, for example, by the first displacement of the piezoelectric element, before ejecting the ink droplets from the nozzle, it is possible to appropriately fill the inside of the ink chamber with the ink. In addition, after that, by the second displacement of the piezoelectric element, it is possible to appropriately push the ink in the ink chamber out to the nozzle. In addition, accordingly, it is possible to appropriately perform the ejecting of the ink droplets from the nozzle.

In addition, in this case, for example, by controlling the displacement amount of the first displacement, it is possible to appropriately control the amount of the ink introduced into the ink chamber before ejecting. By the second displacement after that, the piezoelectric element causes all of the ink in the ink chamber to be ejected from the nozzle, for example. For this reason, in this configuration, for example, it is possible to appropriately control the ejecting volume of the ink droplets with high accuracy. In addition, accordingly, for example, it is possible to more appropriately perform the printing with high accuracy. Furthermore, at the timing of the first displacement of the piezoelectric element, filling the ink chamber with the ink is performed via the ink supply path from the ink storage portion, such as the ink cartridge or the ink tank.

Configuration 12

By changing the volume of the ink droplets to be ejected from the nozzle at the plurality of stages, the printing apparatus performs the multi-gradation printing. The driving signal output portion can output the plurality of types of driving signals which causes displacement amounts different from each other in the first displacement, and selects the driving signal which is supplied to the piezoelectric element that causes the ink droplets to be ejected from the nozzle, corresponding to the volume of the ink droplets to be ejected from the nozzle. In this case, the piezoelectric element causes the different volumes of ink droplets to be ejected from the nozzle according to which of the plurality of types of driving signals is supplied.

In this configuration, for example, by using the plurality of types of driving signals which has different displacement amounts in the first displacement, it is possible to make the volume of the ink droplets ejected from the nozzle corresponding to each of the driving signals different. In addition, accordingly, it is possible to make the size of the dots of the ink formed on the medium by the nozzle variable. For this reason, in this configuration, for example, it is possible to appropriately perform the gradation printing.

In addition, in this case, the displacement amount of the piezoelectric element in the second displacement is, for example, the displacement amount for ejecting all of the ink in the ink chamber from the nozzle after the first displacement. In this configuration, for example, it is possible to appropriately control the volume of the ink droplets ejected corresponding to each of the driving signals with high accuracy.

Configuration 13

There is provided an ink jet head which ejects ink droplets by an ink jet method based on a driving signal including: a nozzle which ejects the ink droplets; an ink chamber which stores ink to be ejected from the nozzle; and a piezoelectric element which causes the ink droplets to be ejected from the nozzle. The piezoelectric element causes all of the ink in the ink chamber to be ejected from the nozzle by being displaced corresponding to the driving signal. In this configuration, for example, it is possible to obtain an effect similar to that in Configuration 1.

Configuration 14

There is provided a printing method which performs printing by an ink jet method and uses an ink jet head which ejects ink droplets based on a driving signal. The ink jet head includes: a nozzle which ejects the ink droplets; an ink chamber which stores ink to be ejected from the nozzle; and a piezoelectric element which causes the ink droplets to be ejected from the nozzle. The piezoelectric element causes all of the ink in the ink chamber to be ejected from the nozzle by being displaced corresponding to the driving signal. In this configuration, for example, it is possible to obtain an effect similar to that in Configuration 1.

Configuration 15

There is provided a printing apparatus which performs printing by an ink jet method including: an ink jet head which ejects ink droplets; and a driving signal output portion which outputs a driving signal that causes the ink droplets to be ejected from the ink jet head. The ink jet head includes: a nozzle which ejects the ink droplets; an ink chamber which stores ink to be ejected from the nozzle; and a piezoelectric element which causes the ink droplets to be ejected from the nozzle. The piezoelectric element causes the ink in the ink chamber to be ejected from the nozzle by being displaced corresponding to the driving signal, and causes the ink to be ejected from the nozzle without performing an operation of pulling the ink already pushed out of the nozzle back to the inside of the nozzle.

The operation of pulling the ink already pushed out of the nozzle back to the inside of the nozzle is, for example, an operation of pulling the ink pushed to the outside of the nozzle back to the inside of the ink chamber. In addition, as the piezoelectric element is displaced corresponding to the driving signal, the piezoelectric element causes the ink which is in a range of 70% to 140% of the volume of the ink chamber in an initial state where the piezoelectric element is not displaced, to be ejected from the nozzle.

Even in this configuration, for example, it is possible to appropriately eject a certain volume of ink droplets regardless of a balance of a plurality of forces which is a balance between a force to push the ink out of the nozzle and a force to pull back the ink after pushing out. In addition, accordingly, for example, it is possible to obtain the effect similar to that in Configuration 1.

Configuration 16

There is provided an ink jet head which ejects ink droplets by an ink jet method based on a driving signal including: a nozzle which ejects the ink droplets; an ink chamber which stores ink to be ejected from the nozzle; and a piezoelectric element which causes the ink droplets to be ejected from the nozzle. The piezoelectric element causes the ink in the ink chamber to be ejected from the nozzle by being displaced corresponding to the driving signal, and ejects the ink from the nozzle without performing an operation of pulling the ink already pushed out of the nozzle back to the inside of the nozzle. In this configuration, for example, it is possible to obtain an effect similar to that in Configuration 15.

Configuration 17

There is provided a printing method which performs printing by an ink jet method and uses an ink jet head which ejects ink droplets based on a driving signal. The ink jet head includes: a nozzle which ejects the ink droplets; an ink chamber which stores ink to be ejected from the nozzle; and a piezoelectric element which causes the ink droplets to be ejected from the nozzle. The piezoelectric element causes the ink in the ink chamber to be ejected from the nozzle by being displaced corresponding to the driving signal, and causes the ink to be ejected from the nozzle without performing the operation of pulling the ink already pushed out of the nozzle back to the inside of the nozzle. In this configuration, for example, it is possible to obtain an effect similar to that in Configuration 15.

According to the invention, for example, when the printing is performed by the ink jet method, it is possible to eject the ink droplets by a more appropriate method.

BRIEF DESCRIPTION OF THE DRAWINGS

FIG. 1A illustrates an example of a configuration of a main part of the printing apparatus. FIG. 1B illustrates an example of a configuration of an ink jet head in the printing apparatus.

FIG. 2A illustrates an example of a configuration of the vicinity of the nozzle. FIG. 2B illustrates another example of a configuration of the vicinity of the nozzle.

FIG. 3A illustrates a state where a piezoelectric element is not displaced by a driving signal. FIG. 3B illustrates an example of a state of each part at a timing of pulling ink back to the inside of an ink chamber. FIG. 3C illustrates an example of a state of each part at a timing of ejecting the ink droplet.

FIG. 4A illustrates an example of an operation of making the volume of the ink droplet variable at the plurality of stages. FIG. 4B illustrates an example of various volumes of the ink droplet.

FIG. 6A is an upper view illustrating an example of the configuration of the vicinity of the nozzle in the ink jet head. FIG. 6B is a cross-sectional view illustrating an example of the configuration of the vicinity of the nozzle.

FIG. 7A illustrates a state where the piezoelectric element is not displaced by the driving signal. FIG. 7B illustrates an example of a state where the piezoelectric element is bent corresponding to the driving signal. FIG. 7C illustrates an example of a state of each part of the ink jet head at a timing of bending of the piezoelectric element.

FIG. 8A illustrates an example of a state of a cross section, regarding a state where the piezoelectric element is bent. FIG. 8B illustrates an example of a state of each part of the ink jet head at the timing of bending of the piezoelectric element.

FIG. 9A illustrates an example of the operation of making the volume of the ink droplet variable at the plurality of stages. FIG. 9B illustrates an example of the various volumes of the ink droplet.

FIG. 10A illustrates an example of a configuration, regarding the modification example of the ink jet head. FIG. 10B illustrates another example of the configuration, regarding the modification example of the ink jet head.

DETAILED DESCRIPTION OF THE INVENTION

Figure 1A:
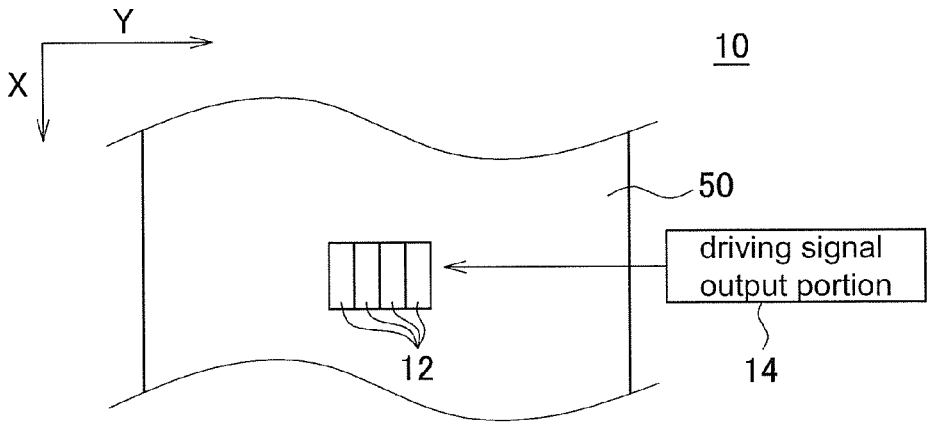
FIGS. 1A and 1B are views illustrating an example of a printing apparatus according to an embodiment of the invention.
Figure 1B:
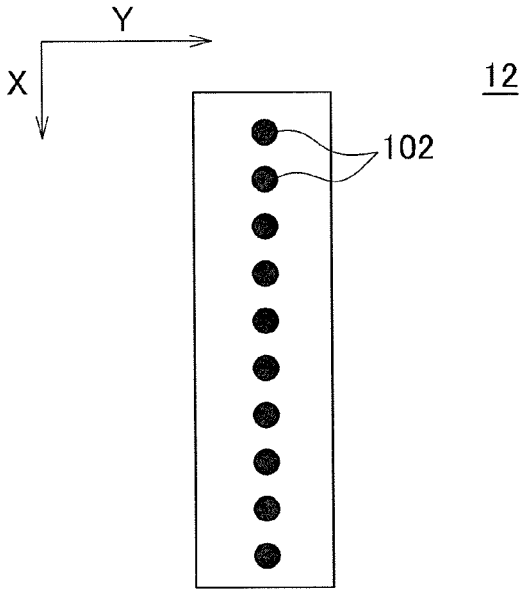

Hereinafter, an embodiment according to the invention will be described with reference to the drawings. FIGS. 1A and 1B are views illustrating an example of a printing apparatus 10 according to an embodiment of the invention. FIG. 1A illustrates an example of a configuration of a main part of the printing apparatus 10. FIG. 1B illustrates an example of a configuration of an ink jet head 12 in the printing apparatus 10.

In the example, the printing apparatus 10 is an ink jet printer which performs printing by an ink jet method with respect to a medium 50, and is provided with a plurality of ink jet heads 12 and a driving signal output portion 14. The plurality of ink jet heads 12 are ink jet heads which eject ink droplets having different colors from each other. Each of the plurality of ink jet heads 12 may be, for example, an ink jet head for respective colors of the inks of CMYK.

In addition, by performing a main scanning operation of ejecting the ink droplets while moving in a preset main scanning direction (Y direction in the drawing), each of the plurality of ink jet heads 12 ejects the ink droplets onto the medium 50. In addition, by performing an auxiliary scanning operation which relatively moves with respect to the medium 50 in an auxiliary scanning direction (X direction in the drawing) perpendicular to the main scanning direction between the main scanning operations, an area where the main scanning operation is performed on the medium 50 is sequentially changed. In addition, according to the operations, the plurality of ink jet heads 12 performs the printing with respect to each position on the medium 50.

In addition, in the example, as illustrated in FIG. 1B, each of the ink jet heads 12 has a plurality of nozzles 102 which is arranged in the auxiliary scanning direction. Corresponding to the driving signal received from the driving signal output portion 14, the ink droplets are ejected from the nozzles.

Furthermore, although not illustrated in FIGS. 1A and 1B, the ink jet heads 12 further have, for example, a configuration for ejecting the ink droplets from the nozzles 102. In addition, for convenience of description, FIGS. 1A and 1B illustrate an example of a configuration in which there is only one row of nozzles in which the plurality of nozzles 102 is arranged in the auxiliary scanning direction. However, for example, in a case where velocity is improved or a case where resolution is improved, the plurality of nozzle rows may be provided. In addition, a more specific configuration and an operation of the ink jet heads 12 will be described in more detail later.

The driving signal output portion 14 is a signal output portion which outputs the driving signal that causes the ink droplets to be ejected from each of the plurality of ink jet heads 12. Corresponding to an image to be printed, for example, the driving signal output portion 14 outputs a driving signal to each of the nozzles 102 of each of the ink jet heads 12. In addition, in the example, outputting the driving signal to the nozzles 102 means outputting the driving signal to a piezoelectric element corresponding to the nozzles 102.

Furthermore, except for the description above and below, the printing apparatus 10 may have, for example, a configuration the same as or similar to that of the known ink jet printer. For example, the printing apparatus 10 may further have various types of configurations which are necessary for an operation of printing in addition to the above-described configuration. More particularly, the printing apparatus 10 may further include, for example, a driving portion which causes the plurality of ink jet heads 12 to perform the main scanning operation and the auxiliary scanning operation.

In addition, the printing apparatus 10 may have, for example, an ink storage portion or an ink supply path as a configuration for supplying the ink which is to be ejected from each of the nozzles 102 of the ink jet heads 12. In this case, the ink storage portion is, for example, an ink tank which stores the ink to be supplied to the ink jet heads 12. An ink cartridge, for example, also can be considered for use as the ink storage portion. In addition, the ink supply path is, for example, an ink tube, and the ink supply path supplies the ink to the ink jet heads 12 from the ink tank or the like by connecting the ink tank and the ink jet heads 12 to each other.

In addition, various types of known inks can be used as the ink which is used in the ink jet heads 12. For example, it is possible to appropriately use UV ink which is hardened by irradiation of ultraviolet rays, or solvent UV ink which dilutes the UV ink by an organic solvent. In addition, it is possible to appropriately use solvent ink, latex ink, or the like. In addition, according to the type of the ink to be used, the printing apparatus 10 may further have, for example, a configuration for fixing the ink onto the medium 50. For example, when the UV ink or the solvent UV ink is used, the printing apparatus 10 may further include an ultraviolet ray irradiation apparatus. In addition, when ink (solvent UV ink, solvent ink, latex ink, emulsion ink, or the like) which is required to be dried is used, the printing apparatus 10 may further have, for example, a heater.

Figure 2A:
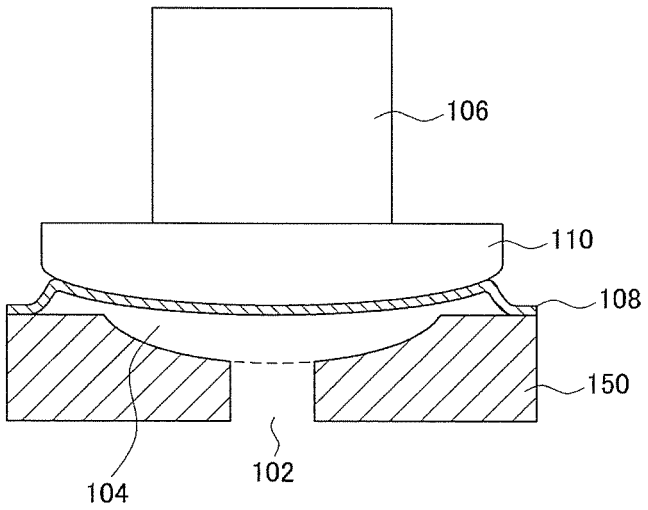
FIGS. 2A and 2B are views illustrating a more detailed configuration of the vicinity of a nozzle.
Figure 2B:
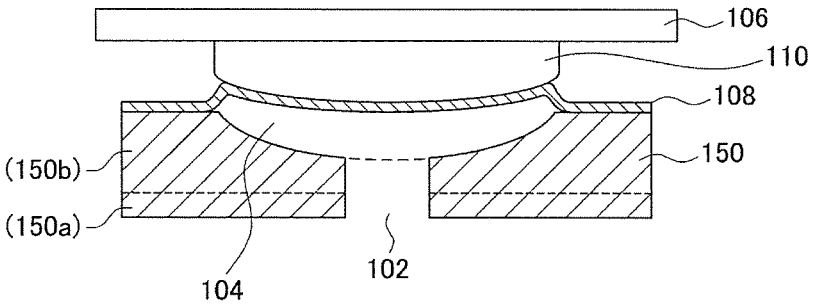

Next, a configuration and an operation of the ink jet heads 12 in the example will be described in more detail. FIGS. 2A and 2B illustrate a more detailed configuration of the vicinity of the nozzle 102 which ejects the ink droplets in the ink jet heads 12. FIG. 2A illustrates an example of a configuration of the vicinity of the nozzle 102.

As illustrated in FIG. 1B, in the example, the ink jet heads 12 have the plurality of nozzles 102 which is arranged in the auxiliary scanning direction. In addition, at the position of each of the nozzles 102, there are further provided a nozzle plate 150, a thin film 108, an ink chamber 104, an elastic member 110, and a piezoelectric element 106.

The nozzle plate 150 has a board-shaped body which has hole-shaped nozzles 102 and a cavity portion connected to the nozzle 102 formed thereon. For example, by forming the nozzles 102 and the cavity portion on one board-shaped body, the nozzle plate 150 is configured to be integrated. In addition, for example, the nozzle plate 150 may be configured to have a plurality of members 150*a* and 150*b* as illustrated as a dotted line in FIG. 2B. In this case, the nozzle plate 150 is divided, for example, into the member 150*a* which is a nozzle surface of the nozzle plate and the member 150*b* which forms the ink chamber, and is formed by adhering the plurality of members 150*a* and 150*b* to each other. In addition, although not illustrated in the drawing, a liquid repellent layer (water repellent layer) may be provided on the surface of the nozzle plate.

Furthermore, the nozzle plate 150 may be a common member with respect to the plurality of nozzles 102. In the example, the nozzle plate 150 may be configured to be integrated, for example, by forming the plurality of nozzles 102 and a plurality of cavity portions on one board-shaped body.

The thin film 108 is a film which covers the cavity portion of the nozzle plate 150 from a side opposite to the nozzles 102. In addition, in the example, by covering the cavity portion of the nozzle plate 150 from the side opposite to the nozzles 102, the thin film 108 forms the ink chamber 104 between the bottom surface of the cavity portion and the thin film 108. For example, the ink chamber 104 is an area in which the ink to be supplied to the nozzles 102 is stored at the previous stage of the nozzles 102. According to this configuration, in the example, the ink chamber 104 stores the ink to be ejected from the nozzles 102 at a position adjacent to the nozzles 102.

Furthermore, the thin film 108 is an example of a thin film which covers an opening portion of the ink chamber 104. It is possible to appropriately use a thin film (film or the like) having a flexibility to be deformed according to the displacement of the piezoelectric element 106 or the like, as the thin film 108.

In addition, although not illustrated in the drawing, the ink jet heads 12 further include, for example, an ink flow path or the like. The ink flow path is, for example, the ink supply path which supplies the ink to the ink jet heads 12 from the ink tank or the like, and a flow path which is connected to the ink chamber 104. In addition, it is preferable that the ink flow path have a position or a structure in which a flow path is closed or a flow path resistance increases at a predetermined timing according to the operation of the piezoelectric element 106 when the ink droplets are ejected.

The elastic member 110 is a member which is made of rubber or the like, and is disposed between the piezoelectric element and the thin film. In addition, in the example, the elastic member 110 is configured to be displaced in the same direction as the piezoelectric element 106 according to the displacement of the piezoelectric element 106. Accordingly, the elastic member 110 transmits the displacement of the piezoelectric element 106 to the thin film 108.

The piezoelectric element 106 is a driving element which causes the ink droplets to be ejected from the nozzles 102, and presses the thin film 108 via the elastic member 110 by being displaced corresponding to the driving signal supplied from the driving signal output portion 14. In addition, accordingly, a pressure is applied to the ink chamber 104, a certain amount of the ink in the ink chamber 104 is pushed out, and the ink droplets are ejected from the nozzles 102. According to the example, for example, by controlling the displacement of the piezoelectric element 106 by the driving signal, it is possible to appropriately eject the certain volume of ink droplets from the nozzles 102. In addition, in the example, the piezoelectric element 106 causes all of the ink in the ink chamber 104 to be ejected from the nozzles 102 at each time of ejecting the ink droplets.

Furthermore, an operation of ejecting the ink droplets from the nozzles 102 will be described in more detail later. In addition, the shape or the size of each configuration illustrated in FIG. 2A can be appropriately changed to be a configuration or the like illustrated in FIG. 2B according to a design specification of the ink jet heads 12, for example.

FIG. 2B illustrates another example of a configuration of the vicinity of the nozzle 102. FIG. 2B illustrates an example of a configuration of a case where the piezoelectric element 106 and the elastic member 110 which have different shapes or sizes, compared to FIG. 2A, are used. In addition, as described above, the nozzle plate 150, which is configured by the plurality of members 150*a* and 150*b*, is used. Even in this configuration, similar to in a case described by using FIG. 2A, by controlling the displacement of the piezoelectric element 106 by the driving signal, it is possible to appropriately eject the ink droplets from the nozzles 102.

Next, the operation of ejecting the ink droplets from the nozzles 102 will be described in more detail. In the example, corresponding to the driving signal, first, by being displaced to the side opposite to the nozzles 102, the piezoelectric element 106 pulls a preset amount of ink into the ink chamber 104. In this case, pulling the ink into the ink chamber 104 means pulling the ink into the ink chamber 104 from the ink tank or the like through a flow path (not illustrated) of the ink which is on the outside of the ink chamber 104. In addition, after that, by being displaced to the side of the nozzles 102, the piezoelectric element 106 causes all of the ink in the ink chamber 104 to be ejected from the nozzles 102.

Figure 3A:
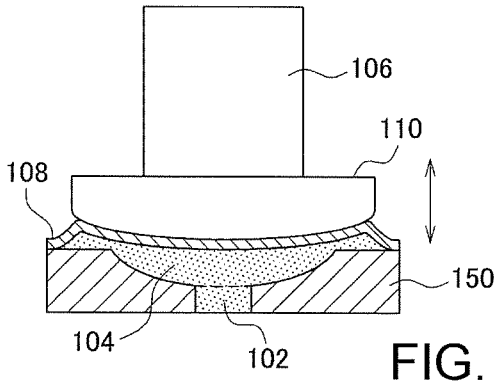
FIGS. 3A to 3C are views illustrating an example of an operation of ejecting ink droplet from the nozzle.
Figure 3B:
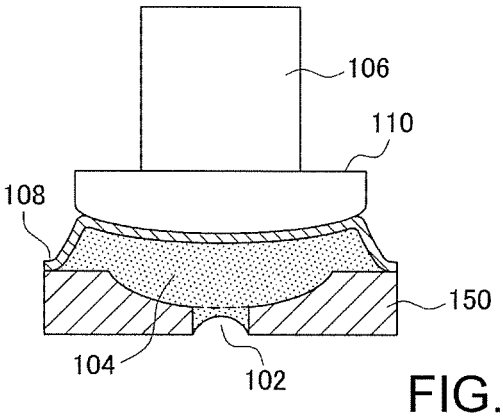
Figure 3C:
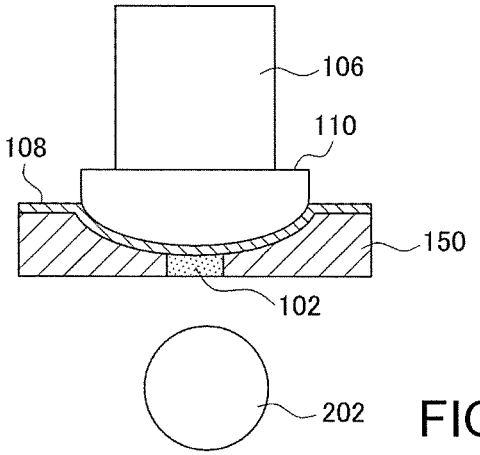

FIGS. 3A to 3C illustrate an example of an operation of ejecting ink droplets from the nozzle 102. FIG. 3A illustrates a state where a piezoelectric element 106 is not displaced by the driving signal. In a state where the piezoelectric element 106 is not displaced by the driving signal, the elastic member 110 is in contact with the thin film 108 at a predetermined initial position, and maintains the amount in the ink chamber 104 at a predetermined initial amount. In addition, accordingly, the ink chamber 104 is in a state of being filled with the initial amount of the ink.

FIG. 3B illustrates an example of a state of each part at a timing of pulling the ink into the ink chamber 104. As described above, when the ink droplets are ejected from the nozzles 102, corresponding to the driving signal, first, the piezoelectric element 106 is displaced to the side opposite to the nozzles 102. Accordingly, the thin film 108 to which the elastic member 110 is attached is pulled up together and moved to the side opposite to the nozzles 102. In addition, accordingly, the ink flows into the ink chamber 104 and the amount in the ink chamber 104 becomes greater than the initial amount.

According to this configuration, for example, by controlling a displacement amount of the piezoelectric element 106 to the side opposite to the nozzles 102, it is possible to appropriately control the amount of the ink to be introduced into the ink chamber 104 before ejecting. In addition, accordingly, before the ejecting, it is possible to appropriately pull the preset amount of the ink into the ink chamber 104.

Furthermore, it is possible to perform the pulling of the ink into the ink chamber 104, for example, by using a supply pressure of the ink. In addition, for example, by moving the elastic member 110 and the thin film 108 integrally by being compatible with the displacement of the piezoelectric element 106, the ink may be pulled into the ink chamber 104.

FIG. 3C illustrates an example of a state of each part at a timing of ejecting ink droplets 202. As described above, after pulling the ink into the ink chamber 104, the piezoelectric element 106 of the example is displaced to the side of the nozzles 102. In addition, accordingly, all of the ink in the ink chamber 104 is ejected from the nozzles 102 as the ink droplets 202.

Furthermore, all of the ink in the ink chamber 104 may be almost all of the ink, for example, substantially all of the ink. In addition, ejecting substantially all of the ink in the ink chamber 104 may mean, for example, ejecting all of the ink in the ink chamber 104 from the nozzles in the designed operation. In the designed operation, this may mean ejecting all of the ink introduced into the ink chamber 104 before ejecting without leaving a part of the ink intentionally by the operation of pulling the ink back to inside of the nozzles 102 or the like.

In addition, in this case, more particularly, the piezoelectric element 106 pushes the elastic member 110 toward a bottom surface (hereinafter, referred to as a bottom surface of the ink chamber 104) of the cavity portion of the nozzle plate 150 which constitutes the ink chamber 104, and deforms the shape of the elastic member 110 which interposes the thin film 108 and is in contact with the bottom surface of the ink chamber 104, into a shape along the shape of the bottom surface of the ink chamber 104. In addition, accordingly, the piezoelectric element 106 presses the thin film 108 so that the thin film 108 is in contact with the bottom surface of the ink chamber 104. In addition, accordingly, almost all of the ink in the ink chamber 104 is ejected from the nozzles 102.

Furthermore, in this case, the thin film 108 being in contact with the bottom surface of the ink chamber 104 means that, for example, the thin film 108 is in contact with the bottom surface of the ink chamber 104 so that the thin film 108 covers the entire bottom surface of the ink chamber 104. In addition, the entire bottom surface of the ink chamber 104 means, for example, a part except for the holes which are the nozzles 102, on the bottom surface of the ink chamber 104.

According to this configuration, for example, it is possible to appropriately eject all of the ink in the ink chamber 104 from the nozzles 102 by the driving signal. In addition, for example, by controlling the displacement amount of the piezoelectric element 106 to the side opposite to the nozzles 102, it is possible to appropriately control the amount of the ink introduced into the ink chamber 104 before ejecting. In addition, after that, by ejecting all of the ink in the ink chamber 104 from the nozzles 102, it is possible to appropriately eject a desired volume of the ink droplets 202 from the nozzles 102 with high accuracy. In addition, it is also possible to appropriately control the velocity of the ink droplets to be ejected at a desired velocity with high accuracy, for example, by independently changing a displacement velocity of the piezoelectric element 106. For this reason, according to the example, for example, it is possible to more appropriately perform the printing with high accuracy.

Furthermore, as a method of adjusting the volume of the ink droplets to a desired amount by a different method from the example, for example, a method (push-pull method) of displacing the piezoelectric element in a direction to pull the ink back to the inside of the nozzles and separating a part of the ink pushed out of the nozzles from a meniscus after pushing the ink out of the nozzles or the like, can be considered. In this case, the part which is separated from the meniscus becomes the ink droplets and flies toward the medium. In addition, in this case, since an extremely small part of the ink in the ink chamber is ejected from the nozzles, the ratio V1/V0 between a capacity (V0) of the ink chamber and a volume (V1) of the ink droplets is generally equal to or less than 0.01 (1%).

However, in this case, since the size of the ink droplets is determined by a balance of a plurality of forces which is a balance between the force to push the ink out of the nozzles and the force to pull the ink back to the inside of the nozzles after pushing out, it is difficult to make the size of the ink droplets uniform with high accuracy. In addition, as a result, there is a concern that an irregularity in the volume of the ink droplets occurs.

In addition, when the ink droplets are ejected by the push-pull method, for example, when the force to push the ink out of the nozzles increases, the velocity of the ink droplets increases and the size of the ink droplets increases at the same time. For this reason, when the small volume of the ink droplets is ejected, there is a case where it is difficult to increase the force to push the ink out of the nozzles. In addition, as a result, there is a case where it is difficult to increase the ejecting velocity of the ink droplets.

In contrast, in the example, for example, because of the configuration in which all of the ink in the ink chamber 104 is ejected as the ink droplets 202, compared to in a case where the extremely small part (for example, equal to or less than 1%) of the capacity of the ink chamber 104 is ejected, the irregularity in the volume of the ink droplets 202 is unlikely to occur. In addition, in a case of the configuration in which all of the ink in the ink chamber 104 is ejected as the ink droplets 202, at the timing of the ejecting, for example, it is possible to use a configuration in which the ink is directly pushed out only by the displacement of the piezoelectric element 106 in a direction in which the pressure is applied to the ink chamber 104. In this case, it is not required that the balance between the force to push out the ink and the force to pull back the ink be considered. For this reason, according to the example, for example, it is possible to appropriately suppress the irregularity in the volume of the ink droplets 202 independently of the velocity of the ink droplets. In addition, accordingly, it is possible to eject the ink droplets 202 by a more appropriate method, and to appropriately perform the printing with high accuracy.

In addition, in a case of the configuration in which all of the ink in the ink chamber 104 is ejected as the ink droplets 202, for example, even when the volume of the ink droplets 202 is small, without considering the operation of pulling the ink back to the inside of the nozzles 102, it is possible to sufficiently increase the force to push out the ink. In addition, accordingly, for example, even when the volume of the ink droplets is small, it is possible to eject the ink droplets at a sufficient ejecting velocity (initial velocity). For this reason, according to the example, for example, even when the small volume of the small-sized ink droplets is ejected, it is possible to sufficiently increase the ejecting velocity, and to reduce the influence of the air resistance applied to the ink droplets. In addition, accordingly, for example, it is possible to more appropriately perform high-definition printing.

In addition, in a case of the configuration in which all of the ink in the ink chamber 104 is ejected, for example, even when the capacity of the ink chamber 104 is small, it is possible to appropriately eject a necessary volume of the ink droplets. For this reason, according to the example, for example, it is also possible to use the ink chamber 104 which has a shallow depth. In addition, accordingly, for example, when the ink chamber 104 is formed by etching or the like, it is easier to manufacture the ink chamber 104 with high accuracy.

Here, in the description above, the configuration of a case where all of the ink in the ink chamber 104 is ejected from the nozzles 102 is described. According to this configuration, for example, it is possible to appropriately eject the certain volume of the ink droplets with high accuracy. However, if the ink is ejected from the nozzles 102 without performing the operation of pulling the ink already pushed out from the nozzles 102 back to the nozzles 102, for example, it can be considered that the ink in a range of 70% to 140% of the amount in the ink chamber 104 in the initial state where the piezoelectric element 106 is not displaced is ejected from the nozzles 102. Even in this configuration, for example, it is possible to appropriately eject the certain volume of ink droplets regardless of the balance of the plurality of forces which is the balance between the force to push the ink out of the nozzles 102 and the force to pull back the ink after pushing out.

In addition, as described above, in the example, by controlling the displacement amount of the piezoelectric element 106 to the side opposite to the nozzles 102, it is possible to appropriately control the amount of the ink to be introduced into the ink chamber 104 before ejecting. In addition, after that, by ejecting all of the ink in the ink chamber 104 from the nozzles 102, it is possible to appropriately eject the desired volume of ink droplets with high accuracy. For this reason, by using the characteristic, in the printing apparatus 10 of the example, for example, it can be considered that the volume of the ink droplets to be ejected from the nozzles 102 is variable at the plurality of stages.

Figure 4A:
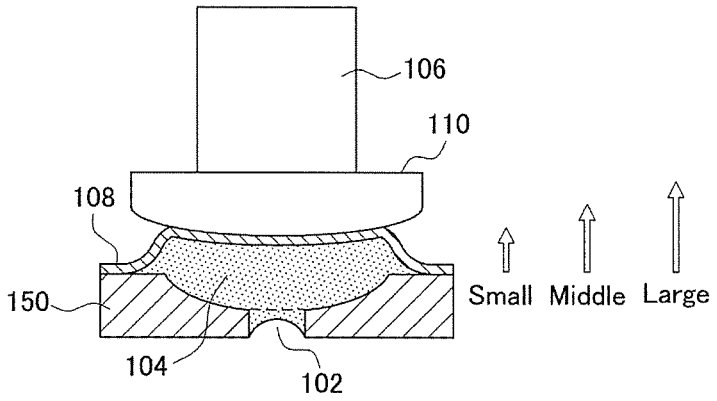
FIGS. 4A and 4B are views illustrating a case where a volume of the ink droplet is variable at a plurality of stages.
Figure 4B:
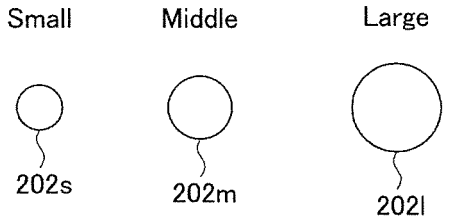

FIGS. 4A and 4B are views illustrating a case where the volume of the ink droplets is variable at the plurality of stages. FIG. 4A illustrates an example of an operation of making the volume of the ink droplets variable at the plurality of stages. FIG. 4B illustrates an example of the various volumes of ink droplets 202*s*, 202*m*, and 202*l*.

When the volume of the ink droplets is variable at the plurality of stages, the driving signal output portion 14 (refer to FIG. 1) outputs the plurality of types of driving signals which causes the displacement amounts different from each other of the piezoelectric element 106 to the side opposite to the nozzles 102 at a timing before ejecting the ink droplets. In this case, the driving signal output portion 14 supplies the driving signal corresponding to the volume of the ink droplets to be ejected from the nozzles 102, with respect to the piezoelectric element 106 at the position of each of the nozzles 102.

In addition, at the timing before ejecting the ink droplets, according to which of the plurality of types of driving signals is supplied, the piezoelectric element 106 at the position of each of the nozzles 102 is displaced to the side opposite to the nozzles 102 only by the displacement amount corresponding to the driving signal. In addition, after that, the piezoelectric element 106 is displaced to the side of the nozzles 102, and causes all of the ink in the ink chamber 104 to be ejected from the nozzles 102. Accordingly, according to which of the plurality of types of driving signals is supplied, the piezoelectric element 106 causes different volumes of the ink droplets, to be ejected from the nozzles.

More particularly, for example, as illustrated in FIG. 4B, when the volume of the ink droplets is variable at the plurality of stages by three stages which are a small volume of the ink droplets 202*s*, a middle volume of the ink droplets 202*m*, and a large volume of the ink droplets 202*l*, the driving signal output portion 14 outputs, for example, the plurality of driving signals corresponding to each of the ink droplets 202*s*, 202*m*, and 202*l*. In addition, at the timing before ejecting the ink droplets, when the driving signal corresponding to the ink droplets 202*s* is received, the piezoelectric element 106 is displaced to the side opposite to the nozzles 102 by the small level of the displacement amount like an arrow illustrated as "Small" in FIG. 4A, for example. In addition, when the driving signal corresponding to the ink droplets 202*m* is received, the piezoelectric element 106 is displaced to the side opposite to the nozzles 102 by the middle level of the displacement amount like an arrow illustrated as "Middle", for example. In addition, when the driving signal corresponding to the ink droplets 202*l* is received, the piezoelectric element 106 is displaced to the side opposite to the nozzles 102 by the large level of the displacement amount like an arrow illustrated as "Large", for example. After that, by being displaced in a direction of nozzles 102, the piezoelectric element 106 causes different volumes of the ink droplets 202*s*, 202*m*, and 202*l*to be ejected from the nozzles 102.

In this configuration, for example, corresponding to the plurality of types of driving signals, it is possible to appropriately make the volume of the ink droplets to be ejected from the nozzles 102 variable at the plurality of stages. In addition, accordingly, for example, it is possible to form dots of the ink having various sizes on the medium. Furthermore, in this case, according to the configuration in which all of the ink in the ink chamber 104 is ejected from the nozzles, it is possible to appropriately suppress the irregularity in the volume of the ink droplets. For this reason, in this configuration, for example, it is possible to appropriately perform the gradation printing (multi-gradation printing) which uses the dots of the ink having various sizes with high accuracy.

Here, as a method of making the volume of the ink droplets to be ejected from the nozzles variable at the plurality of stages, for example, a method (push-pull method) of using the configuration in which the ink is pulled back to the inside of the nozzles after pushing the certain amount of ink out of the nozzles, and controlling the force or timing to pull back the ink can also be considered. However, in a case of this method, due to the difference in the volume of the ink droplets, there is a concern that the ejecting velocity of the ink droplets varies. In addition, as a result, due to the difference in the volume of the ink droplets, it can also be considered that an error of landing position of the ink droplets occurs. More particularly, for example, like in the example, when the main scanning operation is performed and the printing is performed, the landing position of the ink droplets changes by the ejecting velocity of the ink droplets. For this reason, in this case, when the ejecting velocity is changed by the amount of the ink, there is a concern that it is difficult to control the landing position with high accuracy.

In contrast, since the configuration described by using FIGS. 4A and 4B is the configuration in which all of the ink in the ink chamber 104 is ejected from the nozzles 102, for example, the influence of the operation of pulling the ink back to the inside of the nozzles 102 does not occur. For this reason, in this configuration, for example, since the volume of the ink droplets and the ejecting velocity of the ink droplets can be controlled separately, it is possible to appropriately suppress the occurrence of the difference in the ejecting velocity of the ink droplets due to the difference in the volume of the ink droplets. In addition, accordingly, it is possible to more appropriately perform the printing with greater accuracy.

In addition, the specific configuration of the ink jet head 12 or the like is not limited to the above-described configuration, and can be variously changed. Hereinafter, another example of the configuration of the ink jet head 12 will be described.

Figure 5:
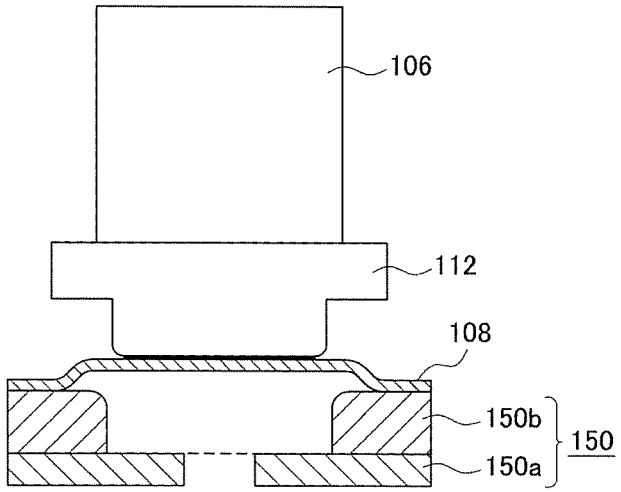
FIG. 5 is a view illustrating an example of the detailed configuration of the vicinity of the nozzle, regarding another example of a configuration of the ink jet head.

FIG. 5 illustrates an example of the detailed configuration of the vicinity of the nozzles 102, regarding another example of a configuration of the ink jet head. Furthermore, except for the description below, in FIG. 5, the configuration which has the same reference numerals as in FIGS. 1A to 4B has characteristics the same as or similar to those in the configuration in FIGS. 1A to 4B.

In this configuration, the nozzle plate 150 is divided into the member 150*a* which is the nozzle surface and the member 150*b* which forms the ink chamber, and is formed by adhering the plurality of members 150*a* and 150*b* to each other. In addition, at the position of each of the nozzles 102, the ink jet head has a rigid member 112 formed of a rigid body, such as a metal or a ceramic, instead of the elastic member 110 in the configuration described above by using FIGS. 2A and 2B or the like, as the configuration for pushing the certain amount of the ink out of the ink chamber. The rigid member 112 has a structure in which the rigid member 112 interposes the thin film 108 and is loosely engaged with the member 150*b* which forms the ink chamber.

In a case of this configuration, for example, it is possible to appropriately eject the certain amount of the ink with high accuracy. In addition, for example, regarding the velocity of the ink droplets to be ejected, by changing the displacement velocity of the piezoelectric element 106, it is possible to appropriately control velocity to be the desired velocity with high accuracy. For this reason, even in this configuration, for example, it is possible to more appropriately perform the printing with high accuracy.

In addition, the configuration of the ink jet head 12 can be considered to be different from the configuration described by using FIGS. 1A to 5, for example, regarding a method of disposing the piezoelectric element. Hereinafter, an example of the configuration in which the method of disposing the piezoelectric element is different will be described.

Figure 6A:
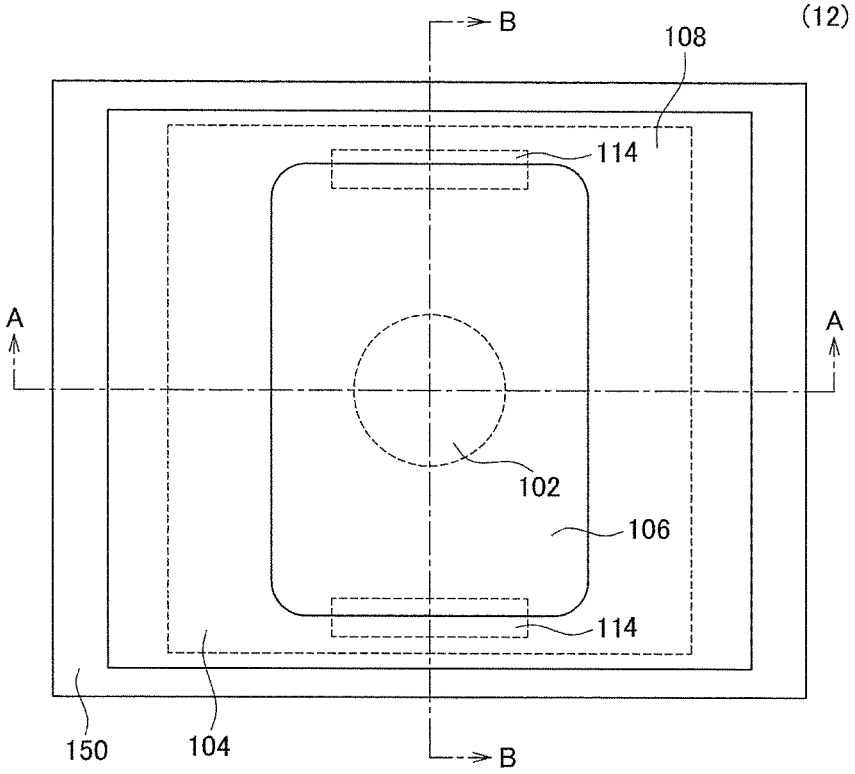
FIGS. 6A and 6B are views illustrating yet another example of the configuration of the ink jet head.
Figure 6B:
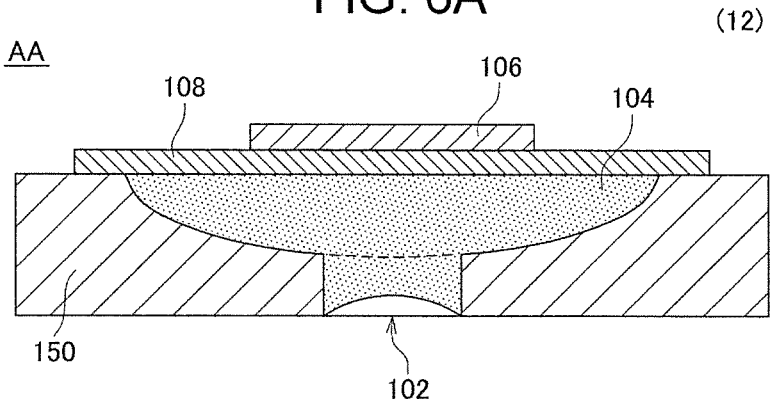

FIGS. 6A and 6B illustrate yet another example of the configuration of the ink jet head 12. FIG. 6A is an upper view illustrating an example of the configuration of the vicinity of the nozzles 102 in the ink jet head 12, relates to the configuration of the inside of the ink jet head 12, and illustrates an example of the configuration of the vicinity of the nozzles 102 when viewed from the side opposite to the nozzle surface on which the nozzles 102 are formed. FIG. 6B is a cross-sectional view illustrating an example of the configuration of the vicinity of the nozzles 102, and illustrates an example of the configuration of a cross section taken along one dot chain line A-A in FIG. 6A. Furthermore, except for the description below, in FIGS. 6A and 6B, the configuration which has the same reference numerals as in FIGS. 1A to 5 has characteristics the same as or similar to those in the configuration in FIGS. 1A to 5. In addition, in the description below, the configuration illustrated in FIGS. 6A and 6B is described as the example.

In the example, a thin film type of a piezoelectric element disposed on the thin film 108 so that the main surface is along the thin film 108, is used as the piezoelectric element 106. In this case, the main surface of the piezoelectric element 106 is, for example, the widest surface in the piezoelectric element 106. In addition, the main surface of the piezoelectric element 106 may be a main surface of a thin film which constitutes the piezoelectric element.

More particularly, the main surface of the piezoelectric element 106 is, for example, overlapped with the opening portion of the ink chamber 104, and the piezoelectric element 106 is disposed so that the main surface is perpendicular to the ejecting direction of the ink droplets by the nozzles 102. The main surface of the piezoelectric element 106 and the ejecting direction of the ink droplets being perpendicular to each other may mean that, for example, in a state where the piezoelectric element 106 is not displaced, according to accuracy of manufacturing of each of the configurations of the ink jet head 12, the main surface and the ejecting direction are substantially perpendicular to each other. More particularly, being substantially perpendicular may mean, for example, being perpendicular in the designed disposition.

In addition, in the example, the piezoelectric element 106 has electrodes 114 which receive the driving signal at one end and at the other end in a direction along the surface of the thin film 108. The direction along the surface of the thin film 108 is, for example, a direction perpendicular to the ejecting direction of the ink droplets by the nozzles 102. In addition, the piezoelectric element 106 may also have the electrodes 114 on the surface and the rear surface of the piezoelectric element 106, for example. In this case, the rear surface of the piezoelectric element 106 is an interface between the piezoelectric element 106 and the thin film 108.

In a case of this configuration, corresponding to the driving signal, the piezoelectric element 106 is displaced, for example, to be bent on the thin film 108. By the displacement, via the thin film 108, the pressure is applied to the ink chamber 104. In this configuration, for example, with respect to the ink chamber 104, it is possible to stably and appropriately apply the pressure. In addition, for example, by controlling the displacement of the piezoelectric element 106 by the driving signal, it is possible to appropriately eject the certain volume of the ink droplets from the nozzles 102.

Here, for example, it is possible to appropriately use the known thin type piezoelectric element or the like as the piezoelectric element 106. In this case, for example, by being attached onto the thin film 108, the piezoelectric element 106 is disposed as described above. In addition, for example, in the manufacturing process of the ink jet head 12, by performing evaporation or spattering onto the thin film 108, it can also be considered that the piezoelectric element 106 is formed on the thin film 108. In this configuration, for example, it is possible to dispose the piezoelectric element 106 with greater accuracy at the desired position. In addition, the piezoelectric element 106 may be covered by stacked resin (coating resin), for example, on the thin film 108. In this configuration, for example, it is possible to dispose the piezoelectric element 106 more stably on the thin film 108.

In addition, at one end and at the other end of the piezoelectric element 106 in the direction along the surface of the thin film 108, the electrodes 114 of the piezoelectric element 106 may be, for example, disposed so that a part is mounted on the thin film 108. In addition, in this case, the part which is mounted on the thin film 108 in the electrodes 114, for example, to be adhered to the thin film 108 can be considered. In this configuration, for example, it is possible to appropriately fix the piezoelectric element 106 onto the thin film 108. In addition, the electrodes 114, for example, may not be disposed separately from the piezoelectric element 106, and may be configured as a part of the piezoelectric element 106. In this case, for example, it is preferable that the piezoelectric element 106 be disposed on the thin film 108 by adhering to the entire surface.

In addition, in the example, in the ink chamber 104, a hole which is connected to the nozzles 102 is formed on the side of the surface facing the medium 50 in the ink jet head 12. In addition, at a position which is different from the hole, there is the opening portion which is covered by the thin film 108. In addition, more particularly, in the ink chamber 104, the hole which is connected to the nozzles 102 is formed on the bottom surface of the cavity which constitutes the ink chamber 104, for example. Accordingly, the bottom surface of the ink chamber 104 is a nozzle forming surface which is the surface on which the hole connected to the nozzles 102 is formed. In addition, the opening portion of the ink chamber 104 is formed on the surface facing the bottom surface, for example. Accordingly, the ink chamber 104 stores the ink to be ejected from the nozzles 102 at a position adjacent to the nozzles 102.

Furthermore, hereinafter, a method of displacing the piezoelectric element 106 or the like will be described in more detail. In addition, as described in more detail below, in the example, at each time of ejecting the ink droplets, the piezoelectric element 106 causes all of the ink in the ink chamber 104 to be ejected from the nozzles 102.

Figure 7A:
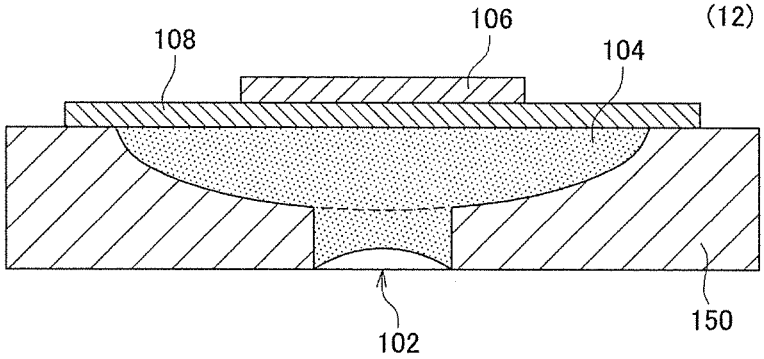
FIGS. 7A to 7C are views illustrating an example of the operation of ejecting the ink droplet from the nozzle.
Figure 7B:
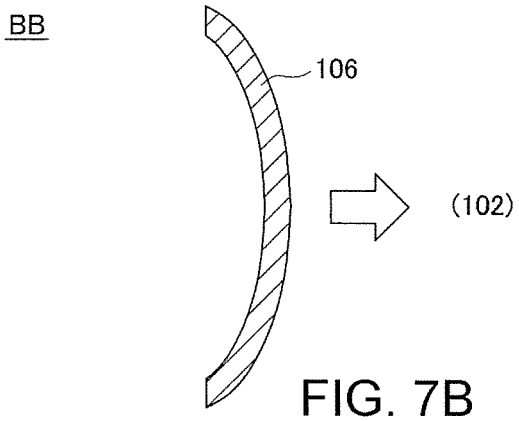
Figure 7C:
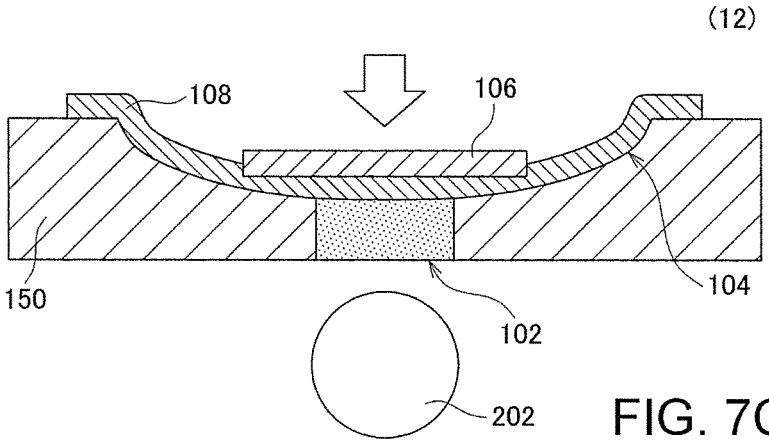

Next, in relation to the example, the operation of ejecting the ink droplets from the nozzles 102 by displacing the piezoelectric element 106 will be described in more detail. FIGS. 7A to 7C illustrate an example of the operation of ejecting the ink droplets from the nozzles 102. FIG. 7A illustrates a state where the piezoelectric element 106 is not displaced by the driving signal. In a state where the piezoelectric element 106 is not displaced by the driving signal, the piezoelectric element 106 is not bent and is flat. In addition, in this case, the ink chamber 104 is in a state of being filled with a predetermined initial amount of the ink.

FIG. 7B is a view illustrating an example of a state where the piezoelectric element 106 is bent corresponding to the driving signal, and regarding a state where the piezoelectric element 106 is bent, illustrates an example of a state of a cross section taken along one dot chain line B-B in FIG. 6A. In this case, a state of the cross section taken along one dot chain line B-B in FIG. 6A is a state of a cross section of a location illustrated as one dot chain line B-B in FIG. 6A in a state where the piezoelectric element 106 is bent. FIG. 7C illustrates an example of a state of each part of the ink jet head 12 at a timing of bending of the piezoelectric element 106.

At the timing of ejecting the ink droplets from the nozzles 102, corresponding to the change in the driving signal, a center portion of the piezoelectric element 106 of the example is bent to face the direction of the nozzles 102. In addition, accordingly, the piezoelectric element 106 applies the pressure to the ink chamber 104 via the thin film 108. In addition, according to the pressure applied to the ink chamber 104 by the piezoelectric element 106, the nozzles 102 eject the ink droplets 202. For this reason, in the example, for example, it is possible to appropriately perform the ejecting of the ink droplets 202 from the nozzles 102.

In addition, in the example, when the ink droplets 202 are ejected from the nozzles 102, the piezoelectric element 106 is displaced so that at least a part of the thin film 108 and at least a part of the bottom surface of the ink chamber 104 are in contact with each other. In addition, more particularly, in a case illustrated in the drawing, the piezoelectric element 106 is displaced so that the thin film 108 is in contact with the entire bottom surface of the ink chamber 104. In this case, the thin film 108 being in contact with the entire bottom surface of the ink chamber 104 means that the thin film 108 is in contact with the bottom surface of the ink chamber 104 so that the thin film 108 covers the entire bottom surface of the ink chamber 104 as illustrated in FIG. 7C, for example. In addition, accordingly, when the ink droplets 202 are ejected, the piezoelectric element 106 causes all of the ink in the ink chamber 104 to be ejected from the nozzles 102.

Here, in the example, for example, the bottom surface of the ink chamber 104 is formed in a shape which is compatible with the method of displacing the piezoelectric element 106. The method of displacing the piezoelectric element 106 is, for example, a method of deflecting the piezoelectric element 106 at a time of bending of the piezoelectric element 106 corresponding to the driving signal when the ink droplets 202 are ejected. More particularly, the shape of the bottom surface of the ink chamber 104 can be considered as, for example, a shape which appears round that is compatible with a bending amount of the piezoelectric element 106 and a shape in which the depth toward the center portion gradually increases in a direction which links one end and the other end provided with the electrodes in the piezoelectric element 106. In this configuration, for example, when the ink droplets 202 are ejected, it is possible to appropriately bring the thin film 108 and the bottom surface of the ink chamber 104 into contact with each other. In addition, for example, it can be considered that the shape of the bottom surface is the shape which appears round and the shape in which the depth toward the center portion gradually increases even in the direction perpendicular to the direction which links the electrodes in the piezoelectric element 106.

In addition, as the shape of the bottom surface of the ink chamber 104 is the above-described shape, when the ink droplets 202 are ejected, it is possible to appropriately displace the piezoelectric element 106 in a shape which is along the bottom surface of the ink chamber 104. In addition, accordingly, according to the displacement of the piezoelectric element 106, it is possible to appropriately eject all of the ink in the ink chamber 104 from the nozzles 102.

In addition, in the example, the piezoelectric element 106 is disposed, for example, so that the main surface interposes the thin film 108 and is overlapped with the opening portion of the ink chamber 104. For this reason, in the example, for example, it is possible that the piezoelectric element 106 and the thin film 108 are appropriately in contact with each other in a wide area. In addition, accordingly, for example, it is possible to appropriately displace the piezoelectric element 106 in a form along the shape of the ink chamber 104. For this reason, in the example, even in this state, it is possible to more stably perform the ejecting of the ink droplets.

Furthermore, in the description above, for convenience of the description, first, only the displacement of the piezoelectric element 106 at the timing of ejecting the ink droplets 202 is described. However, in the operation of real printing, for example, before the timing of ejecting the ink droplets 202, it can also be considered that the piezoelectric element 106 is displaced in a reverse direction and a predetermined amount of the ink is supplied to the ink chamber 104, or the like. In this case, corresponding to the change in the driving signal, for example, first, the piezoelectric element 106 performs a first displacement in which the center portion is bent to face the direction opposite to the nozzles 102. After that, a second displacement is performed in which the center portion is bent to face the direction of the nozzles. In addition, in this case, according to the first displacement of the piezoelectric element 106, for example, the ink is supplied from the ink tank or the like via the ink supply path to the ink chamber 104. In addition, according to the second displacement of the piezoelectric element 106, the nozzles 102 eject the ink droplets. Hereinafter, this operation will be described in more detail.

Figure 8A:
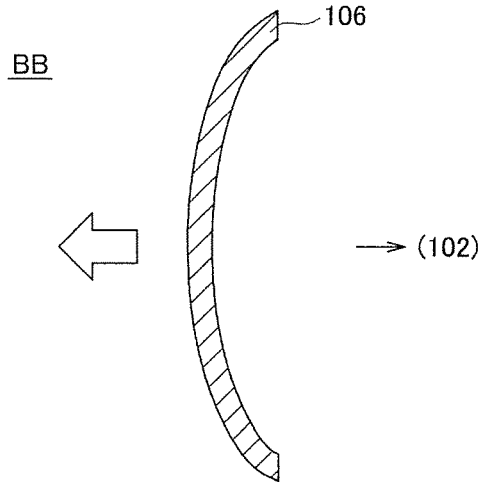
FIGS. 8A and 8B are views illustrating a first displacement which is a displacement of the piezoelectric element at a timing of supplying the ink to the ink chamber.
Figure 8B:
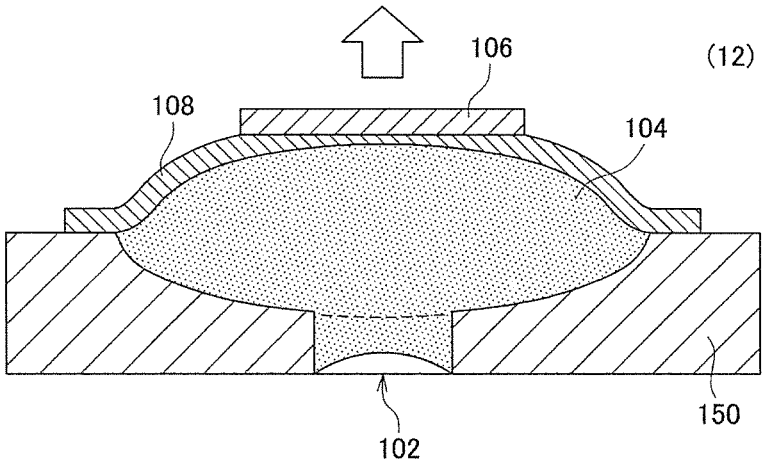

FIGS. 8A and 8B are views illustrating the first displacement which is the displacement of the piezoelectric element 106 at a timing of supplying the ink to the ink chamber 104. FIG. 8A illustrates an example of a state of a cross section taken along the one dot chain line B-B in FIG. 6A, regarding a state where the piezoelectric element 106 is bent in the first displacement. FIG. 8B illustrates an example of a state of each part of the ink jet head 12 at the timing of bending of the piezoelectric element 106, regarding the first displacement of the piezoelectric element 106.

In the example, corresponding to the driving signal, first, the piezoelectric element 106 performs the first displacement in which the center portion is bent to face the direction opposite to the nozzles 102. In this case, the center portion being bent to face the direction opposite to the nozzles 102 means that the piezoelectric element 106 is bent so that the center portion of the piezoelectric element 106 is apart from the nozzles 102 as illustrated in the drawing. Accordingly, the piezoelectric element 106 pulls up the thin film 108 to the direction apart from the nozzles 102, and widens the ink chamber 104. In addition, according to this operation, the ink is pulled into the ink chamber 104. For this reason, in this configuration, for example, before ejecting the ink droplets from the nozzles 102, it is possible to appropriately fill the inside of the ink chamber 104 with the ink.

Furthermore, in this operation, pulling the ink into the ink chamber 104 means, for example, pulling the ink into the ink chamber 104 from the ink tank or the like via the ink supply path. It is possible to perform the pulling of the ink, for example, by using the supply pressure of the ink to the ink chamber 104 from the ink supply path. In addition, in the example, corresponding to the driving signal, by performing the first displacement of the preset displacement amount, the piezoelectric element 106 pulls the preset amount of the ink into the ink chamber 104.

In addition, in this case, as the ink flows into the ink chamber 104 by the first displacement of the piezoelectric element 106, the amount in the ink chamber 104 becomes greater than the initial amount before the displacement of the piezoelectric element 106. For this reason, in this case, for example, the amount in the ink chamber 104 in a state where the piezoelectric element 106 performs the first displacement may be considered as the amount in the ink chamber 104.

In addition, after performing the first displacement, the piezoelectric element 106 performs the second displacement in which the center portion is bent to face the direction of the nozzles. The second displacement is, for example, a displacement of the piezoelectric element 106 described by using FIGS. 7A to 7C. In addition, accordingly, the piezoelectric element 106 causes all of the ink in the ink chamber 104 to be ejected from the nozzles 102.

According to the example, for example, by controlling the displacement amount of the first displacement, it is possible to appropriately control the amount of the ink to be introduced into the ink chamber 104 before ejecting. In addition, by the second displacement of the piezoelectric element 106 performed after that, it is possible to appropriately eject the ink having an amount pulled into the ink chamber 104 from the nozzles 102. For this reason, according to the example, for example, it is possible to appropriately eject the desired volume of the ink droplets from the nozzles 102 with high accuracy.

In addition, the example has a configuration in which all of the ink in the ink chamber 104 is pushed out of the nozzles 102 by the second displacement of the piezoelectric element 106. In this case, it is possible to eject the ink droplets from the nozzles 102 at the ejecting velocity according to the displacement velocity in the second displacement. For this reason, even regarding the ejecting velocity of the ink droplets, for example, by adjusting the displacement velocity in the second displacement of the piezoelectric element 106, for example, regardless of the volume of the ink droplets, it is possible to appropriately control the desired velocity with high accuracy. Therefore, in the example, for example, it is possible to more appropriately perform the printing with high accuracy. In addition, accordingly, even when the volume of the ink droplets is small, it is possible to appropriately increase the ejecting velocity.

Furthermore, in the second displacement of the piezoelectric element 106, in order to increase the ejecting velocity of the ink droplets sufficiently, it is preferable that the displacement velocity sufficiently increase. Meanwhile, in the first displacement of the piezoelectric element 106 which is performed to pull the ink into the ink chamber 104, for example, it is preferable that the ink be appropriately pulled into the ink chamber 104 at a flow-in velocity according to the supply pressure of the ink, or the displacement velocity not increase to equal to or higher than a necessary level in a viewpoint of preventing the occurrence of an unnecessary disorder in the ink in the ink chamber 104. For this reason, it can be considered that the displacement velocity in the first displacement of the piezoelectric element 106 is less than the displacement velocity in the second displacement. In this case, the displacement velocity of the piezoelectric element 106 is, for example, an amount of bending of the piezoelectric element 106 per predetermined unit time.

In addition, as described above, in the example, by controlling the displacement amount of the piezoelectric element 106 to the side opposite to the nozzles 102, it is possible to appropriately control the amount of the ink to be introduced into the ink chamber 104 before ejecting. In addition, by ejecting all of the ink in the ink chamber 104 from the nozzles 102 after that, it is possible to appropriately eject the desired volume of the ink droplets with high accuracy. For this reason, even in the printing apparatus 10, for example, similar to in the case described by using FIGS. 4A and 4B and the like, it can also be considered that the volume of the ink droplets to be ejected from the nozzles 102 at the plurality of stages is changed, and that the gradation printing is performed.

Figure 9A:
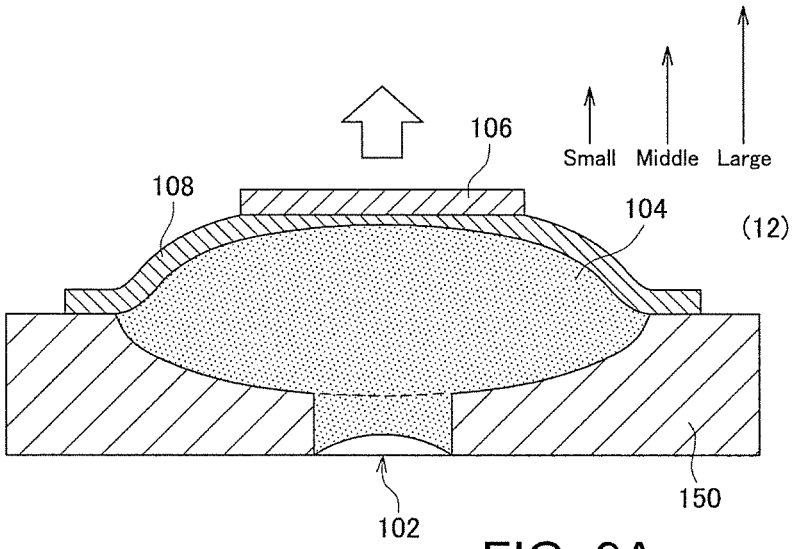
FIGS. 9A and 9B are views illustrating a case where the volume of the ink droplet is variable at the plurality of stages.
Figure 9B:
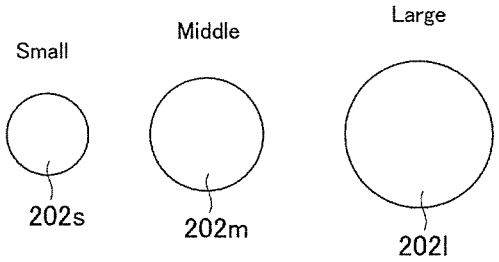

FIGS. 9A and 9B are views illustrating a case where the volume of the ink droplets is variable at the plurality of stages. FIG. 9A illustrates an example of the operation of making the volume of the ink droplets variable at the plurality of stages. FIG. 9B illustrates an example of the various volumes of the ink droplets 202*s*, 202*m*, and 202*l*.

When the volume of the ink droplets is variable at the plurality of stages, for example, as the driving signal output portion 14 (refer to FIG. 1), a configuration in which each of the plurality of types of driving signals which has different displacement amounts in the first displacement can be output, is used. According to the volume of the ink droplets ejected from each of the nozzles 102 in the ink jet head 12, the driving signal which is supplied to the piezoelectric element 106 that causes the ink droplets to be ejected from each of the nozzles 102, is selected.

In this case, according to which of the plurality of types of driving signals is supplied, the piezoelectric element 106 performs the first displacement only by the displacement amount corresponding to the driving signal. In addition, accordingly, the ink is pulled into the ink chamber 104 according to the displacement amount of the first displacement. By performing the second displacement for ejecting the ink droplets from the nozzles 102 after that, all of the ink in the ink chamber 104 is ejected from the nozzles 102.

According to this configuration, for example, according to the amount of the ink pulled into the ink chamber 104, it is possible to appropriately make the volume of the ink droplets to be ejected from the nozzles 102 different. In addition, accordingly, according to each of the plurality of types of driving signals, it is possible to eject the different volumes of the ink droplets from the nozzles 102. For this reason, in this configuration, for example, it is possible to appropriately perform the gradation printing.

Furthermore, regarding the plurality of types of driving signals, the displacement amounts of the piezoelectric element 106 in the second displacement may be the same, for example. The displacement amount of the piezoelectric element 106 in the second displacement is, for example, a displacement amount compared to the initial state where the piezoelectric element 106 is not displaced.

In addition, more particularly, for example, as illustrated in FIG. 9B, when the volume of the ink droplets is variable at the plurality of stages by three stages which are a small volume of the ink droplets 202*s*, a middle volume of the ink droplets 202*m*, and a large volume of the ink droplets 202*l*, the driving signal output portion 14 outputs, for example, the plurality of driving signals corresponding to each of the ink droplets 202*s*, 202*m*, and 202*l*. In addition, at the timing before ejecting the ink droplets, when the driving signal corresponding to the ink droplets 202*s* is received, in the first displacement, the piezoelectric element 106 is displaced to the side opposite to the nozzles 102 by the small level of the displacement amount like an arrow illustrated as "Small" in FIG. 9A, for example.

In addition, when the driving signal corresponding to the ink droplets 202*m* is received, in the first displacement, for example, the piezoelectric element 106 is displaced to the side opposite to the nozzles 102 by the middle level of the displacement amount like an arrow illustrated as "Middle", for example. In addition, when the driving signal corresponding to the ink droplets 202*l* is received, in the first displacement, the piezoelectric element 106 is displaced to the side opposite to the nozzles 102 by the large level of the displacement amount like an arrow illustrated as "Large", for example. After that, by performing the second displacement which displaces the piezoelectric element in the direction of the nozzles 102, the piezoelectric element 106 causes different volumes of the ink droplets 202*s*, 202*m*, and 202*l* to be ejected from the nozzles 102.

In this configuration, for example, corresponding to the plurality of types of the driving signals, it is possible to appropriately make the volume of the ink droplets to be ejected from the nozzles 102 variable at the plurality of stages. In addition, accordingly, for example, it is possible to farm the dots of the ink having the plurality of sizes on the medium. Furthermore, in this case, according to the configuration in which all of the ink in the ink chamber 104 is ejected from the nozzles 102, it is possible to appropriately suppress the irregularity of the volume of the ink droplets. For this reason, in this configuration, for example, it is possible to appropriately perform the gradation printing which uses the dots of the ink having the plurality of sizes with high accuracy.

Here, even when the thin film type piezoelectric element which is disposed on the thin film 108 so that the main surface is along the thin film 108 is used, it is possible to further change or the like the configuration, not being limited to the configuration described by using FIGS. 6A to 9B. Hereinafter, a modification example of the configuration of the ink jet head 12 will be described.

Figure 10A:
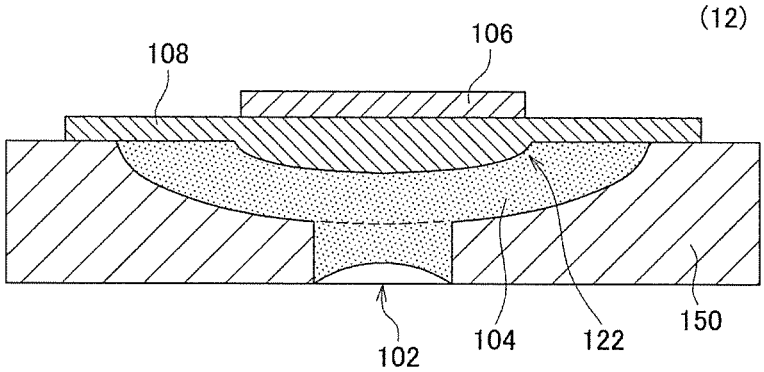
FIGS. 10A and 10B are views illustrating an example of a configuration of the vicinity of the nozzle, regarding modification example of a configuration of the ink jet head.
Figure 10B:
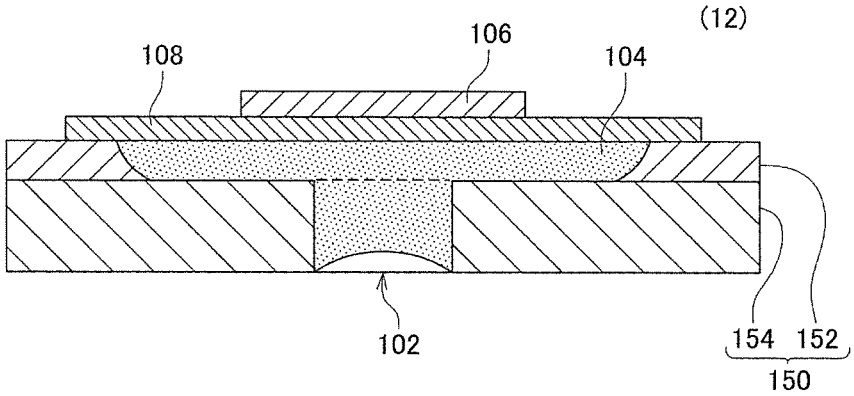

FIGS. 10A and 10B illustrate an example of a configuration of the vicinity of the nozzles 102, regarding the modification example of the configuration of the ink jet head 12. Furthermore, except for the description below, in FIGS. 10A and 10B, the configuration which has the same reference numerals as in FIGS. 1A to 9B has characteristics the same as or similar to those in the configuration in FIGS. 1A to 9B.

FIG. 10A illustrates an example of the configuration, regarding the modification example of the ink jet head 12. As described above, when the ink droplets are ejected, it is preferable that all of the ink in the ink chamber 104 be ejected by the nozzles 102. For this, for example, when the ink droplets are ejected, it is preferable that the thin film 108 and the bottom surface of the ink chamber 104 be as adhered to each other closely as possible.

In addition, as the configuration in which the thin film 108 and the bottom surface of the ink chamber 104 are likely to be adhered to each other closely, more particularly, using thin film 108 having a convex portion 122 as described in FIG. 10A can be considered, for example. In this case, the convex portion 122 is a protruded part of a shape which is compatible with the shape of the bottom surface of the ink chamber 104, and is provided on the surface of the side facing the nozzles 102 in the thin film 108. In this configuration, for example, when the ink droplets are ejected, it is possible to more appropriately adhere the thin film 108 and the bottom surface of the ink chamber 104 to each other closely.

FIG. 10B illustrates another example of the configuration, regarding the modification example of the ink jet head 12. The shape of the bottom surface of the ink chamber 104, for example, can also be considered to be that a part which is in contact with the thin film 108 is flat. In addition, in particular, it is preferable that the peripheral part of the hole which is connected to the nozzles 102 be flat among the parts which are in contact with the thin film 108. Even in this configuration, for example, when the ink droplets are ejected, it is possible to more appropriately adhere the thin film 108 and the bottom surface of the ink chamber 104 to each other closely.

In addition, in the ink jet head 12, the nozzle plate 150 may be formed by the plurality of members. For example, in the configuration illustrated in FIG. 10B, the nozzle plate 150 is configured by a first member 152 and a second member 154 which are the plurality of members. The first member 152 and the second member 154 are board-shaped members which constitute the nozzle plate 150 by being overlapped and adhered to each other. In addition, in each of the first member 152 and the second member 154, the hole or the cavity corresponding to the plurality of nozzles 102 and the plurality of ink chambers 104 in the ink jet head 12, is formed.

In this configuration, for example, as illustrated in FIG. 10B, by using a part of an upper surface of the second member 154 as a part of the bottom surface of the ink chamber 104, it is possible to appropriately set the depth of the ink chamber 104 with high accuracy. In addition, accordingly, for example, it is possible to appropriately set the capacity of the ink chamber 104 with greater accuracy. In addition, it is easy to make the bottom surface of the ink chamber 104 flat, or the like. For this reason, in this configuration, for example, it is possible to more appropriately form the ink chamber 104 having the desired shape. In addition, accordingly, for example, it is possible to appropriately control the volume of the ink droplets with greater accuracy.

Furthermore, regarding a specific configuration of the ink jet head 12 or the like, it is possible to further use another configuration in addition to the above-described modification example or the like. For example, regarding the disposing of the piezoelectric element 106 on the thin film 108, for example, it can also be considered that another member is interposed between the thin film 108 and the piezoelectric element 106, without disposing the piezoelectric element 106 directly on the thin film 108. For example, as necessary, the elastic member or the like may be disposed between the thin film 108 and the piezoelectric element 106. In this configuration, for example, it is possible to more appropriately adjust the method of bending of the piezoelectric element 106.

Above, the invention is described by using the embodiments. However, the technical range of the invention is not limited to the range described in the above-described embodiments. In the above-described embodiments, it is apparent to those skilled in the art that various changes and improvements can be added. It is apparent that the aspects added by such changes and improvements can be included in the technical range of the invention, from the description of the range of the claims.

The invention can be suitably used for a printing apparatus, for example.

What is claimed is:

1. A printing apparatus which performs printing by an ink jet method, comprising:

an ink jet head which ejects ink droplets;

an ink storage portion and an ink supply path, for supplying an ink to the ink jet head; and a driving signal output portion which outputs a driving signal that causes the ink droplets to be ejected from the ink jet head, wherein the ink jet head includes:

a nozzle plate, having: a hole-shaped nozzle which ejects the ink droplets and a cavity portion connected to the hole-shaped nozzle;

an ink chamber which stores ink to be ejected from the nozzle, and the ink chamber is formed between a bottom surface of the cavity portion and a thin film by covering the cavity portion of the nozzle plate from a side opposite to the nozzle, and the thin film has flexibility;

an ink flow path, being connected to the ink supply path and the ink chamber; and a piezoelectric element which causes the ink droplets to be ejected from the nozzle, wherein corresponding to the driving signal, the piezoelectric element is displaced to the side opposite to the nozzle and pulls a preset amount of the ink into the ink chamber through the ink flow path, and then the piezoelectric element is displaced to the side of the nozzle, the thin film is pressed to be brought into contact with a bottom surface of the cavity portion of the nozzle plate, so that the piezoelectric element causes all of the ink in the ink chamber to be ejected from the nozzle.

2. The printing apparatus according to claim 1, wherein the ink jet head further includes: an elastic member which is disposed between the piezoelectric element and the thin film, and wherein at a timing of ejecting the ink droplets from the nozzle, the piezoelectric element presses the thin film via the elastic member.

3. The printing apparatus according to claim 1, wherein the driving signal output portion outputs a plurality of types of the driving signals which has different displacement amounts to the side opposite to the nozzle, and wherein the piezoelectric element causes different volumes of ink droplets to be ejected from the nozzle according to which of the plurality of types of the driving signals is supplied.

4. The printing apparatus according to claim 1, wherein a main surface of the piezoelectric element is fixed on the thin film to be along the thin film, corresponding to a change in the driving signal, by performing a first displacement which bends a center portion of the piezoelectric element to face a direction opposite to the nozzle, the piezoelectric element pulls the preset amount of the ink into the ink chamber, and then, by performing a second displacement which bends the center portion to face a direction of the nozzle, the piezoelectric element is displaced in a shape along a surface on which the hole connected to the nozzle is formed in the ink chamber, and causes all of the ink in the ink chamber to be ejected from the nozzle.

5. The printing apparatus according to claim 4, wherein the piezoelectric element has electrodes which receive the driving signal at one end and at the other end in a direction along a surface of the thin film.

6. The printing apparatus according to claim 4, wherein by changing a volume of the ink droplets to be ejected from the nozzle at a plurality of stages, the printing apparatus performs a multi-gradation printing, and wherein the driving signal output portion is capable of outputting a plurality of types of driving signals which causes displacement amounts different from each other in the first displacement, and selects the driving signal which is supplied to the piezoelectric element that causes the ink droplets to be ejected from the nozzle, corresponding to the volume of the ink droplets to be ejected from the nozzle.

* * * * *

UNITED STATES PATENT AND TRADEMARK OFFICE

CERTIFICATE OF CORRECTION

PATENT NO. : 9,272,510 B2
APPLICATION NO. : 14/504441
DATED : March 1, 2016
INVENTOR(S) : Masaru Ohnishi It is certified that error appears in the above-identified patent and that said Letters Patent is hereby corrected as shown below:

On the title page item (30) Foreign Application Priority Data "Apr. 26, 2014 (JP)..... 2014-084628" should be changed to -- Apr. 16, 2014 (JP)..... 2014-084628 --.

Signed and Sealed this
Seventh Day of June, 2016

Michelle K. Lee

Michelle K. Lee
*Director of the United States Patent and Trademark Office*